US007587843B2

(12) United States Patent
Demers

(10) Patent No.: US 7,587,843 B2
(45) Date of Patent: Sep. 15, 2009

(54) PORTABLE ICE RESURFACING DEVICE AND METHOD

(76) Inventor: Alain P. Demers, 404 Fourth Range Rd., Suncook, NH (US) 03275

( * ) Notice: Subject to any disclaimer, the term of this patent is extended or adjusted under 35 U.S.C. 154(b) by 228 days.

(21) Appl. No.: 11/447,361

(22) Filed: Jun. 6, 2006

(65) Prior Publication Data

US 2007/0277402 A1 Dec. 6, 2007

(51) Int. Cl.
*E01H 4/00* (2006.01)

(52) U.S. Cl. ..... 37/222; 37/219; 37/223; 299/25

(58) Field of Classification Search ..... 37/195, 37/219, 221, 222, 223, 241, 227, 228, 230, 37/196; 299/24, 25
See application file for complete search history.

(56) References Cited

U.S. PATENT DOCUMENTS

| | | | | | |
|---|---|---|---|---|---|
| 1,647,066 | A | | 10/1927 | Westman | |
| 2,642,679 | A | | 6/1953 | Zamboni | |
| 2,795,870 | A | | 6/1957 | Leduc | |
| 3,404,470 | A | * | 10/1968 | Raiti | 37/228 |
| 3,475,056 | A | * | 10/1969 | Jones | 299/24 |
| 3,504,434 | A | | 4/1970 | Thomsen | |
| 3,622,205 | A | | 11/1971 | Zamboni | |
| 3,670,359 | A | * | 6/1972 | Gutbrod | 15/348 |
| 3,705,746 | A | * | 12/1972 | McLeod | 299/25 |
| 3,888,544 | A | * | 6/1975 | Bennett | 172/49.5 |
| 3,917,350 | A | * | 11/1975 | Bricher | 299/24 |
| 4,125,915 | A | | 11/1978 | Zamboni | |
| 4,307,524 | A | * | 12/1981 | Anderson | 37/242 |
| 4,317,298 | A | | 3/1982 | Methers | |
| 4,586,275 | A | | 5/1986 | Henry et al. | |
| 4,918,844 | A | | 4/1990 | Marsh | |
| 5,771,698 | A | | 6/1998 | Abel | |
| 6,138,387 | A | | 10/2000 | Fox et al. | |
| 6,421,870 | B1 | * | 7/2002 | Basham et al. | 15/83 |
| 6,904,708 | B2 | * | 6/2005 | Rogers | 37/228 |

FOREIGN PATENT DOCUMENTS

| | | |
|---|---|---|
| CA | 2522359 | 10/2005 |

* cited by examiner

*Primary Examiner*—Gary S Hartmann
(74) *Attorney, Agent, or Firm*—McLane, Graf, Raulerson & Middleton, P.A.; Scott C. Rand

(57) ABSTRACT

An apparatus and method for resurfacing an ice surface. The apparatus includes a chassis and a reservoir for holding water to be dispensed via a dispensing tube in fluid communication with the reservoir. A scraper assembly attached to the chassis includes a scraper blade adapted to engage the ice surface. A first thrower is rotatably mounted to the chassis adjacent to the scraper blade and a second thrower is rotatably mounted to the chassis adjacent to the first thrower. A snow storage compartment has an opening adjacent the second rotating thrower. The first rotating thrower is adapted to deliver ice or snow accumulated by the blade to the second rotating thrower. The second rotating thrower then delivers the ice or snow to the snow storage compartment. A motor is coupled to the chassis and a drive linkage is coupled to the motor for rotatably driving the first and second throwers.

19 Claims, 6 Drawing Sheets

PORTABLE ICE RESURFACING DEVICE AND METHOD

BACKGROUND

The present disclosure relates to ice resurfacing devices and, more particularly, to portable, self-contained ice resurfacing devices. The embodiments described herein are particularly well-suited for use in resurfacing relatively small ice rinks (for example, about 3,500 square feet or less) where other types of motorized or vehicle-type units are not practical due to the limited space they have to operate in.

One problem with practice rinks and other smaller ice surfaces is that they are commonly cleaned and resurfaced manually using brooms, hand scrapers, squeegees, and the like, and water is typically applied to the rink surface using a hose. Such manual resurfacing is very time consuming thereby reducing the ice time available for skating. Such manual resurfacing also leaves an ice surface which is not as desirable as those resurfaced by large vehicle-type resurfacers.

Another problem with resurfacing smaller scale ice surfaces is that repeated watering gradually increases the thickness of the ice, thus causing the refrigeration system to have to work harder to freeze water on the surface. To remove the excess ice thickness, the refrigeration system must be shut down and water removed as the ice melts.

Although the present embodiments are described herein primarily in connection with relatively small-scale ice rinks, it will be recognized that the embodiments herein may be employed in connection with any ice surface that would benefit from resurfacing, including indoor, outdoor, large scale, small scale, commercial, or private rinks.

Accordingly, the present disclosure contemplates a new and improved ice resurfacing device which overcomes the above-referenced problems and others.

SUMMARY

In one aspect, an apparatus for resurfacing an ice surface includes a chassis and a reservoir on the chassis for holding water to be dispensed. A dispensing tube having a plurality of spaced-apart apertures extends transversely relative to the chassis and is in fluid communication with the reservoir. A scraper assembly is attached to the chassis and includes a scraper blade extending transversely relative to the chassis and adapted to engage the ice surface. A first thrower is rotatably mounted to the chassis adjacent to the scraper blade and is rotatable about a first axis extending transversely relative to the chassis. A second thrower rotatably mounted to the chassis adjacent to the first thrower is rotatable about a second axis parallel to the first axis. A snow storage compartment has an opening adjacent the second rotating thrower. The first rotating thrower is adapted to remove ice or snow accumulated by the blade from the ice surface and to deliver such ice or snow to the second rotating thrower. The second rotating thrower is positioned to receive ice or snow delivered by the first rotating thrower and to deliver such ice or snow to the snow storage compartment. A motor is coupled to the chassis and a drive linkage is coupled to the motor for rotatably driving the first and second rotating throwers.

In another aspect, a method for resurfacing an ice surface, includes moving an ice resurfacing device over the ice surface, the ice resurfacing device including a chassis and a reservoir on the chassis for holding water to be dispensed. The surface of the ice is scrapped with a scraper assembly attached to the chassis, the scraper assembly including a scraper blade extending transversely relative to the chassis and adapted to engage the ice surface. Snow collected by the scraper assembly is removed from the ice surface with a first thrower rotatably mounted to the chassis adjacent to the scraper blade and rotatable about a first axis extending transversely relative to the chassis. Snow removed from the ice surface by the first thrower is delivered to a second thrower rotatably mounted to the chassis adjacent to the first thrower and rotatable about a second axis parallel to the first axis. Snow received by the second rotating thrower is delivered to a snow storage compartment having an opening adjacent the second rotating thrower. A volume of water is directed from the reservoir to a dispensing tube extending transversely relative to the chassis, the dispensing tube in fluid communication with the reservoir and having a plurality of spaced-apart apertures.

One advantage of the presently disclosed embodiment is that it can scrape, remove store snow, and deliver water all in one pass, thereby allowing resurfacing of a rink surface to be performed in a more timely manner relative to manual methods, therefore reducing down time and increasing available ice time. It has been found that resurfacing a typical small scale rink using the present development takes approximately 50-70% less time than the manual methods. For a commercial rink, this results in increased availability of ice rink rental time.

Another advantage of the present development is found in that it may be adapted to remove the same amount of ice as it puts down, thereby leaving the ice level constant over repeated resurfacings.

Yet another advantage of the present embodiment is that it provides proper cleaning and scraping of the ice surface and controlled water dispensing, resulting in a more uniform sheet of ice than can be obtained with the manual methods commonly employed for smaller rinks.

Other benefits and advantages of the present disclosure will become apparent to those skilled in the art upon a reading and understanding of the preferred embodiments.

BRIEF DESCRIPTION OF THE DRAWINGS

The invention may take form in various components and arrangements of components, and in various steps and arrangements of steps. The drawings, wherein like reference numerals are used for like or analogous components throughout the several views, are only for purposes of illustrating preferred embodiments and are not to be construed as limiting the invention.

DETAILED DESCRIPTION OF THE PREFERRED EMBODIMENTS

Figure 1:
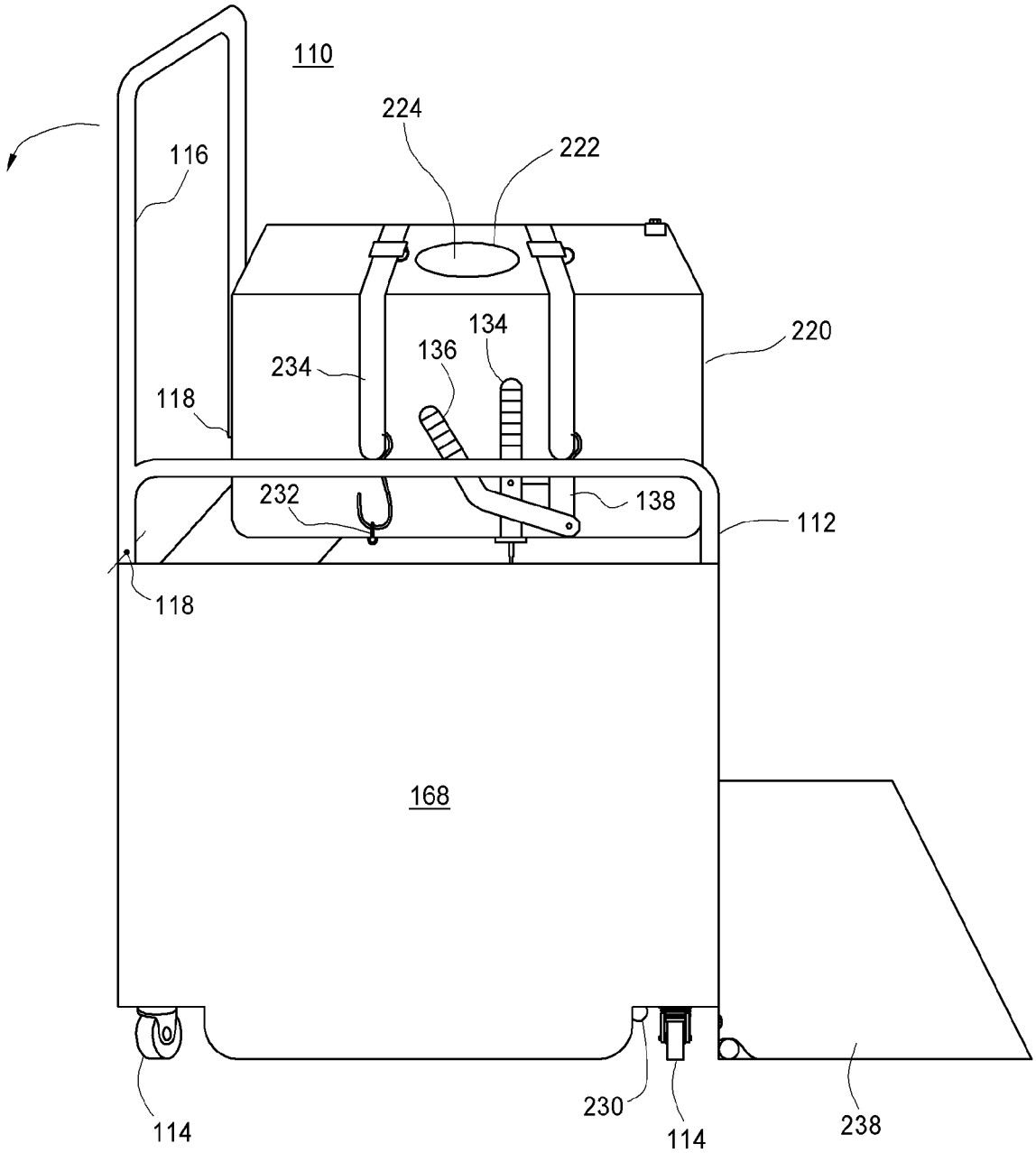
FIG. 1 is a right side perspective view of an exemplary embodiment of the ice resurfacing device.
Figure 2:
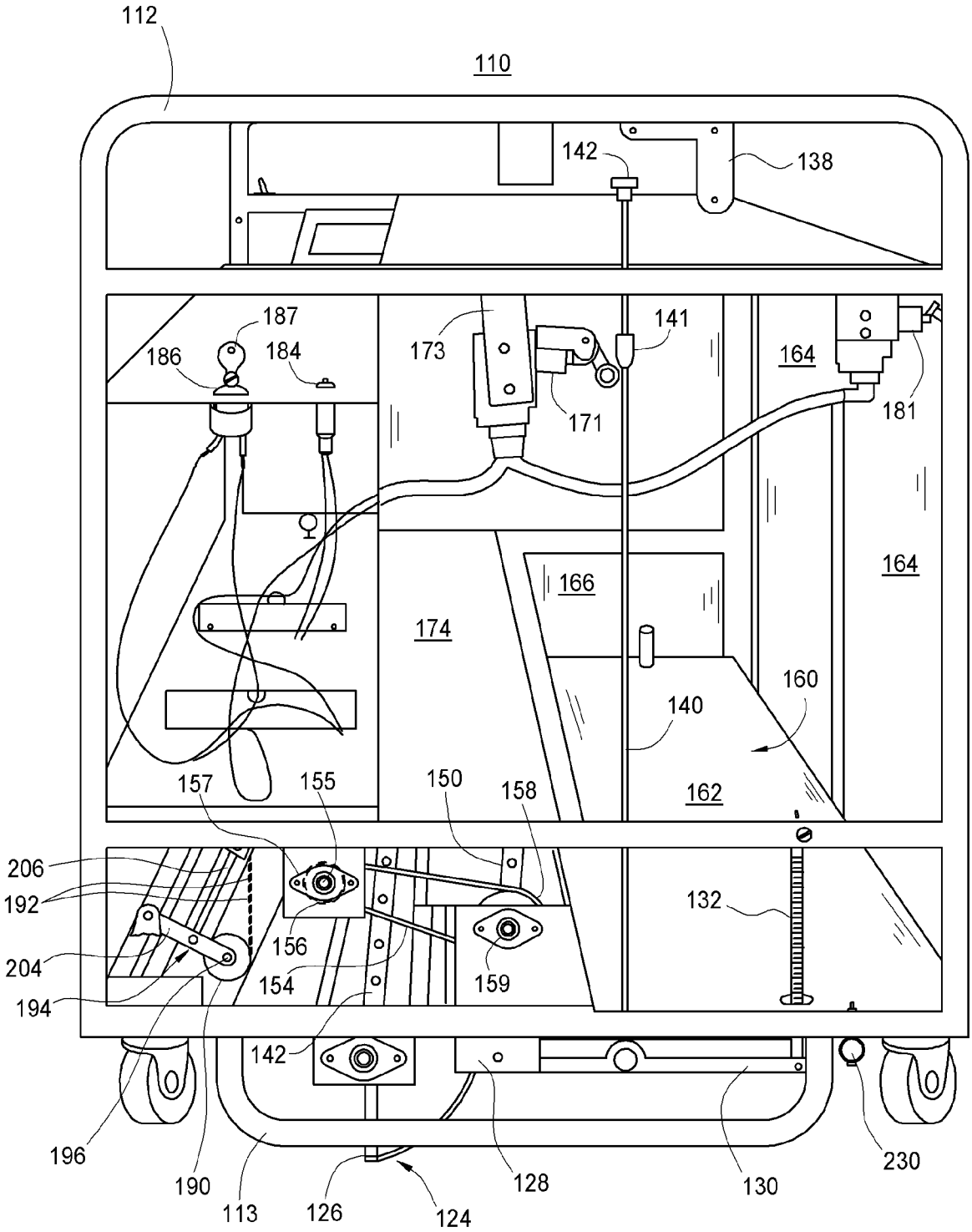
FIG. 2 is a right side perspective view of the embodiment shown in FIG. 1, with the outer housing removed.
Figure 3:
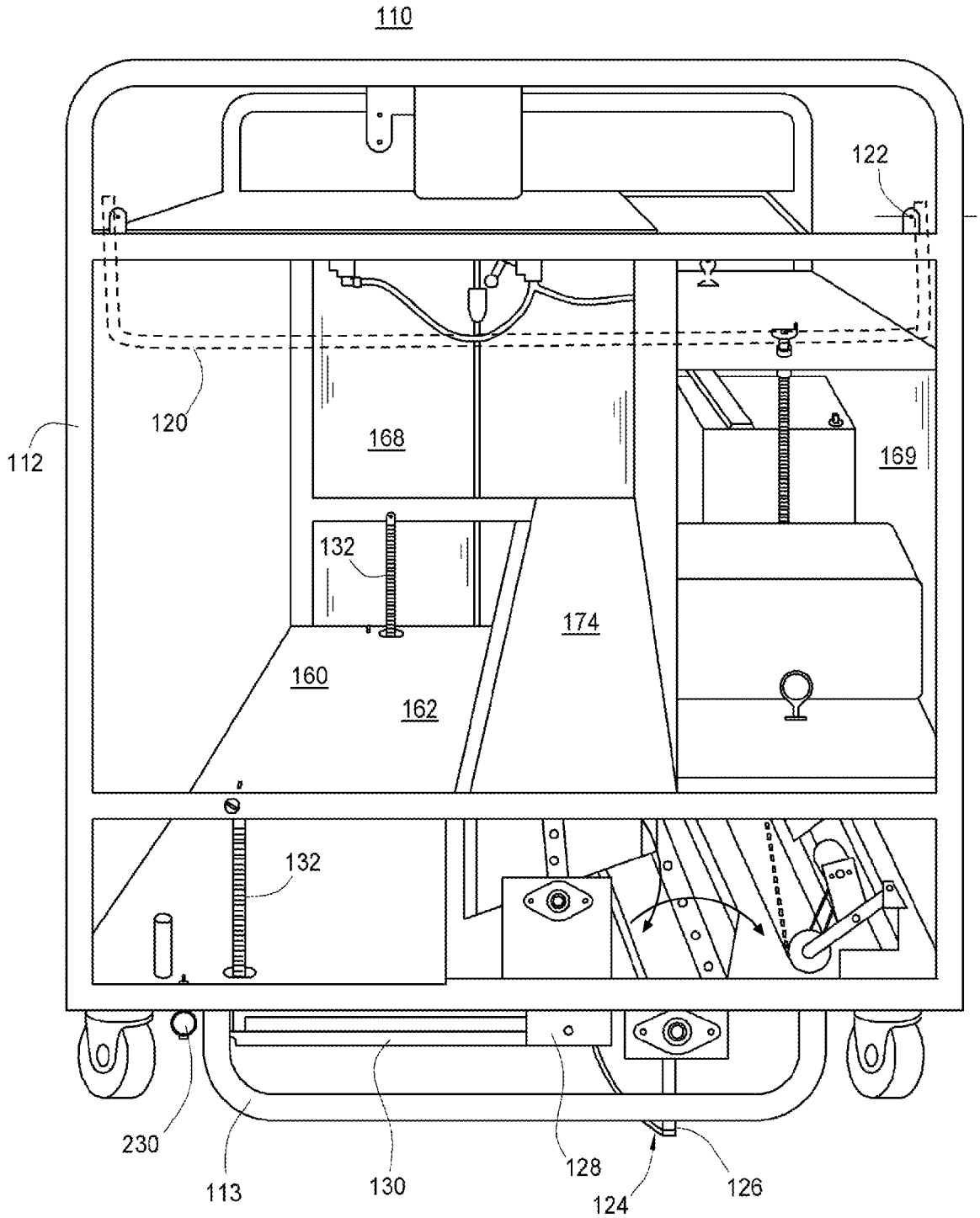
FIG. 3 is a left side perspective view of the embodiment shown in FIG. 1, with the outer housing removed.
Figure 4:
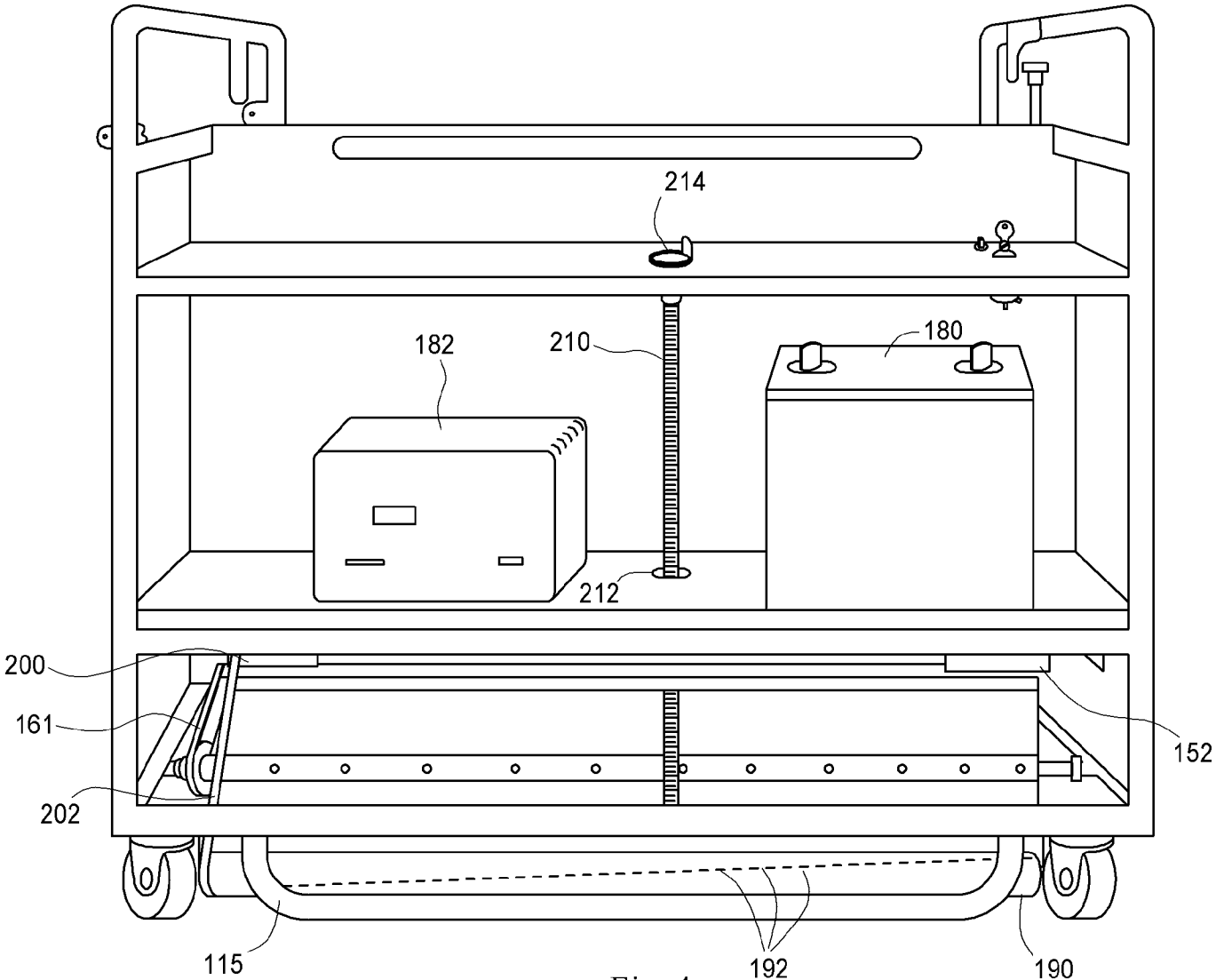
FIG. 4 is a front perspective view of the embodiment shown in FIG. 1, with the outer housing removed.
Figure 5:
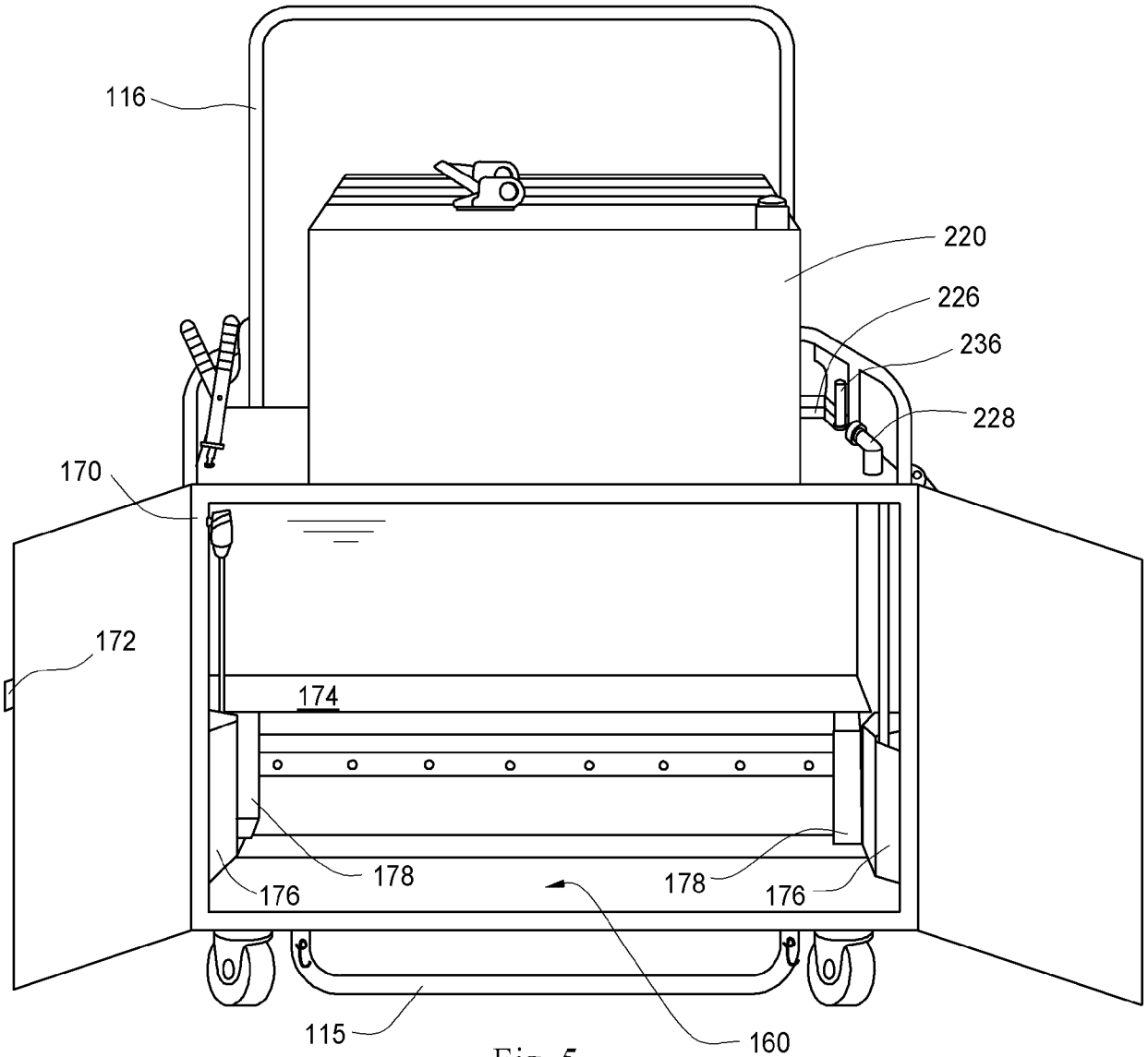
FIG. 5 is a rear perspective view of the embodiment shown in FIG. 1, with the outer housing removed.
Figure 6:
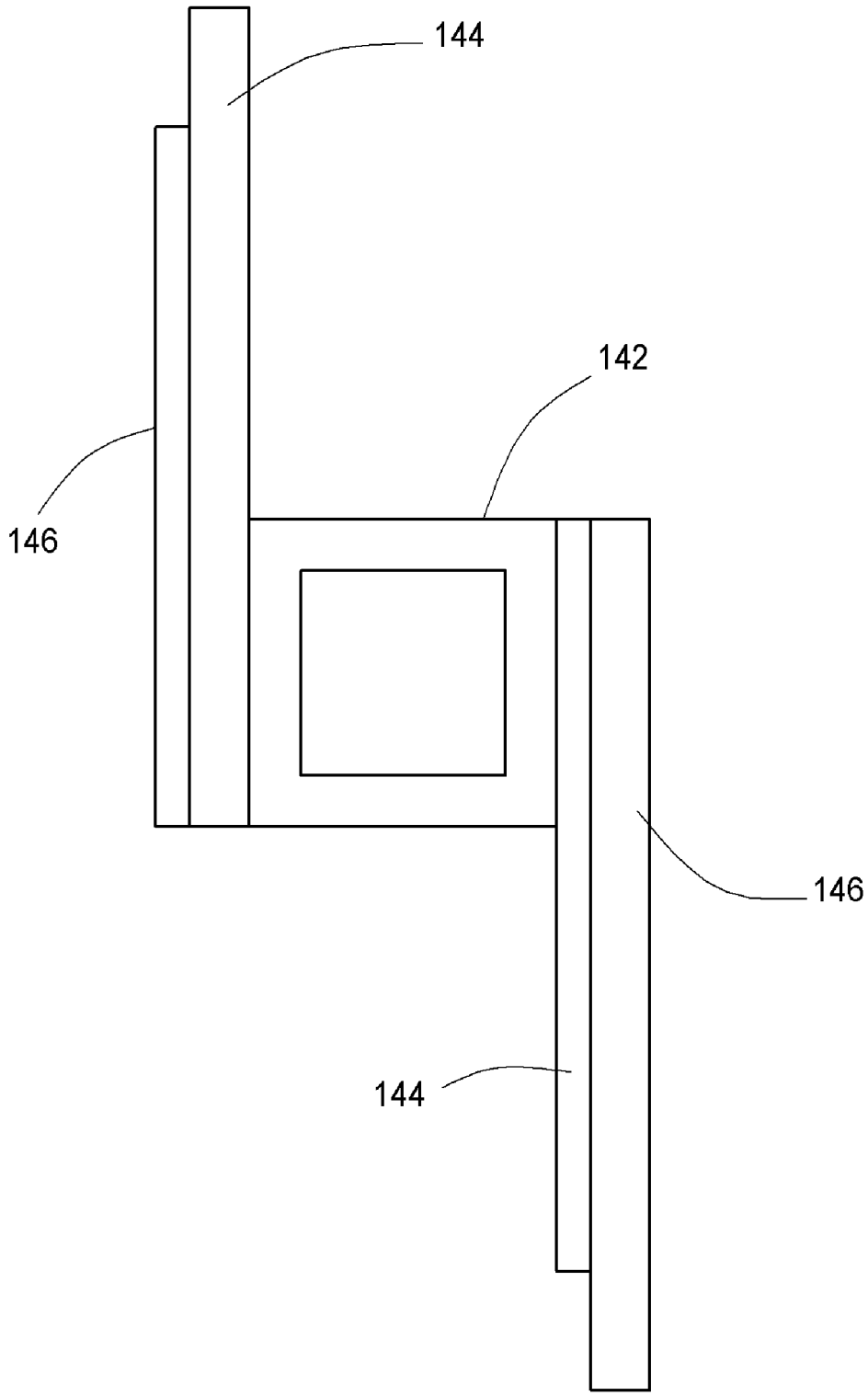
FIG. 6 is an enlarged cross-sectional view of exemplary rotating throwers employed herein.

As used herein, unless specifically stated otherwise, relative terms such as upper, lower, top, bottom, and similar terms are used in reference to the orientation shown in the drawings; terms such as front, rear, forward, rearward, and the like are made in reference to the direction of travel of the apparatus during operation; and the terms left and right are in reference to an operator facing the front of the apparatus.

Referring now to FIGS. 1-6, an ice resurfacing apparatus 110 in accordance with an exemplary embodiment includes a frame or chassis 112. The frame 112 may be formed of any desired material and is preferably a metal or alloy such as steel, aluminum or aluminum alloy, and so forth. The frame 112 may be formed of square tubing which can be welded or otherwise fastened together to form an assembly.

The frame 112 is supported on wheels 114, preferably swivel caster wheels or the like. A handle 116 is attached to the frame 112 for pulling or pushing the unit 110. In the depicted preferred embodiment, the handle 116 is pivotally attached to the frame 112 via pivot points 118 to allow the handle to be moved between an upright position (see FIG. 1) for storage and a lowered position for operation.

In the embodiment depicted in FIG. 1, the handle is in a position to allow the operator to pull the unit by the handle. By pulling the unit 110, the operator can avoid treading on the freshly resurfaced ice before it has had time to fully harden. However, it will be recognized that, if desired, the device 110 could readily be adapted for push-type operation, for example, by relocating the handle 116 from the front of the device (as shown in FIG. 1) to the opposite, rearward side of the device.

A side handle 120 may also be provided for sideways movement. Preferably, the handle 120 is pivotally attached to the frame 112 to provide pivoting movement about a pivot axis 122 between a lowered stored position (see FIG. 3) and an upright, operational position.

The frame 112 may also include left and right side skids 113 and front and rear skids 115. The skids 113, 115 extend downwardly from the periphery of the frame base to protect the mechanics of the unit from damage if unit is being moved over an uneven surface.

A scraper assembly 124, which is preferably formed of a metal such as a galvanized metal, includes a cutting or scraper edge 126 which bears against the ice surface to be resurfaced to scrape imperfections in the ice, as well as snow and ice shavings. The scraper assembly 124 is attached to a pivoting support block 128 which, in turn, is connected to a pair of arms 130. Each arm 130 is connected at its proximal end to the pivot block 128 and at its distal end opposite the first end to a spring 132. In the depicted embodiment a first end of each spring 132 is attached to a respective one of the arms 130 and at the opposite end to the frame 112.

In the depicted embodiment, the springs 132 are coils springs, although other types of springs such as leaf springs could be used. The springs 132 urge the distal ends of the arms 130 in the upward direction, thereby rotatably urging the edge 126 of the scraper assembly 124 against the ice surface.

The scraper 124 may be raised and lowered by means of stop and run levers 134 and 136, respectively, which are attached to a linkage plate 138 on the frame 112. A control rod 140 is attached to one of the arms 130. The control rod 140 is attached to a top hat 142 and engages the levers 134 and 136. The control rod 140 provides a mechanical linkage between the levers 134, 136 and the scraper assembly 124. In operation, engaging stop lever 134 causes control rod 140 to move downward. This, in turn, causes a downward pivoting of the arms 130 against the bias of the springs 132 and an upward pivoting of the scraper blade 126 away from the ice surface. In this manner, damage to the scraper blade or hanging up on any foreign objects can be avoided when the apparatus is not being used. The run lever 136 is used to release the stop lever 134, thereby allowing the arms 130 to pivot upward and the scraper blade 126 to pivot downward to the operable position.

A first rotating thrower 142 is mounted to the frame 112 and extends transversely adjacent the scraper 124. The thrower 142 includes two axially extending blades or fins 144. In certain embodiments, the blades may be of squeegee type formed of rubber or other flexible or resilient material. In other embodiments the blades may be of a brush type, which may be formed of a flexible bristle material. A strip 146 of rigid material, preferably Lexan or other polymeric material may be provided to reinforce the blade 144. If has been found that the use of a squeegee-type blade is preferable when there is excess water on the surface of the ice to be resurfaced.

The first rotating thrower 142 cleans the ice and delivers the snow and ice scraped from the ice surface by the scraper 124 up the curved surface of the scraper and delivers it to a second rotating thrower 150. The second rotating thrower 150 is mounted to the frame 112 transversely, parallel to the first rotating thrower 142. The second rotating thrower 150 may be either of the squeegee and brush types described above by way of reference to the first rotating thrower, and may be the same or different than the first rotating thrower 142.

In the depicted embodiment, both the first and second rotating throwers 142 and 150 are driven by a common motor 152. A timing belt 154 and pulleys 156 and 158 are employed to couple rotational movement of the motor drive shaft 155 to the second rotating thrower 150. Alternately, the timing belt and pulleys could be replaced with a timing chain and gears or sprockets. Each of the throwers 142 and 150 are rotatably supported on the frame 112 at each end via bearing assemblies 159. Rotational movement of the second rotating thrower 150 is coupled to the first rotating thrower 142 using a timing belt of chain 161 engaging appropriate gears, sprockets, or pulleys.

The motor 152 is preferably waterproof. The motor 152 includes a rotating drive shaft 155 which is rotatably supported at its end by a support bearing 157.

In the depicted preferred embodiment, the radial extent of the fins of the first and second rotating throwers is such that each thrower defines a path of movement which is overlapping with the other. Thus, the pulleys, gears, or sprockets are such that the first and second throwers rotate in timed relation so as to avoid collision.

In certain embodiments, the first and second rotating throwers rotate at the same rate. In other embodiments, the rate of the second rotating thrower is a multiple of the rate of the first rotating thrower. In preferred embodiments, the second rotating thrower rotates at a rate which is twice the rotational rate of the first rotating thrower. In a particularly preferred embodiment, the first rotating thrower rotates at a rate of about 850 rpm and the second rotating thrower rotates at a rate of about 1700 rpm.

Although a belt or chain driven system is illustrated in the depicted embodiments, it will be recognized that one or both of the chain or belt drive mechanisms could be replaced with a gear train.

The snow and ice delivered by the first rotating thrower 142 is thrown to the rear of a snow storage compartment 160 by the second rotating thrower 150. Although the volumes defined by the rotational path of the first and second throwers are overlapping, the first and second throwers are synchronized via the timing mechanism so as to avoid collision of the blades of the first and second throwers. Thus, the radius of the scraper 124 in conjunction with the first rotating thrower 142 provides for the snow movement from the ice surface to the path of the second thrower 150. The timing between the thrower 142 and 150 allows for delivery of the removed snow to a storage compartment 160.

The snow storage compartment 160 is defined by a floor panel 162, rear door panels 164, left side wall housing panel 166 and right side wall housing panel 168. The left and right side exterior panels 166, 168, as well as front exterior panel 169 may be formed of any suitable sheet material, and are preferably aluminum or a plastic, e.g., acrylonitrile butadiene styrene (ABS) plastic.

The doors 164 may be opened by the operator to facilitate removal of collected ice and snow after a resurfacing operation has been completed. The doors are mounted with a hinge 170 and may include a door hook or latch 172. A deflector panel 174 is provided above the second thrower 150 to ensure that snow launched by the second thrower will be directed toward the rear of the snow storage compartment 160.

The snow storage compartment 160 of the depicted embodiment also includes spring guards 176 which protects the tension springs 132 and prevents inadvertent contact therewith when snow is removed from the compartment 160 via the door opening following a resurfacing operation. Also appearing in the compartment 160 are pulley, cog gear, or sprocket guards 178, which may be provided for safety reasons.

In the depicted preferred embodiment, the motor 150 is powered by a direct current electrical system including a battery 180, such as a 12-volt battery. A battery charger 182 may be provided to recharge the battery 180 when not in use, e.g., by plugging into a 110-volt AC outlet. The battery charger 182 may be housed within the apparatus 110. A safety circuit breaker 184 may also be provided for added protection for the equipment.

The motor 152 may be selectively turned on and off via a switch 186. The switch 186 is preferably a keyed switch requiring a key 187 to operate the unit.

One or more interlock or safety devices may optionally be provided to prevent operation of the apparatus when a hazardous or unsafe condition exists. For example, the illustrated embodiment includes an optional limit switch 171 electrically coupled to the motor 152 and the battery 180. The limit switch 171 is mounted to the frame 112, e.g., via mounting bracket 173, adjacent the control rod 140. The control rod 140 engages the switch 171, e.g., via a protruding trip member 141 which opens the switch 171 when the scraper 124 is moved to the raised position. Thus, the motor 152 cannot start when the blade is in the elevated position, thereby preventing the first rotating thrower 142 from crashing into the scraper. The switch trip 141 closes the switch 171 when the scraper 124 is moved to the lowered, operable position, thereby enabling operation of the motor 152 only when the scraper is moved to the lowered, operable position.

Likewise, a safety limit switch 181 which is electrically coupled to the power supply 180 and motor 152 may be provided to prevent operation of the motor 152 when the rear clean out doors 164 are not in the closed position.

An optional ice shaving system may also be provided. The ice shaving system positioned forward of the scraper blade 124 and is advantageous in that it removes a thin layer of ice and thereby prevents the gradual build up of ice thickness upon repeated resurfacing of the ice surface.

The ice shaving system includes a drum or cylinder 190 having ice shaving or cutting points, teeth, or the like 192. The drum 190 is connected to the frame 112 by a linkage 194 and is rotatably supported at each end by bearings 196. The cutters 192 may be made of carbide or high speed steel. In the depicted embodiment, the ice shaving system is powered by a second motor 200. A belt or timing belt or chain 202 transmits rotational motion from the second motor 200 via appropriate gears, sprockets, pulleys, or the like.

The second motor 200 may be powered by battery 180, or, by a dedicated power supply. The second motor may have a separate switch (not shown), or may be controlled by the switch 186. It is recognized that in embodiments wherein the optional ice shaving system is provided, it may be desirable to perform a resurfacing operation without using the shaving system to shave the surface of the ice. Thus, in certain embodiments, the switch 186 may be a three-way switch movable between a first, "off" position, a second, "on" position wherein only the first and second throwers are employed, and a third "on" position wherein both the first and second throwers and the cylinder 190 are employed.

In the illustrated embodiment the linkage 194 includes pivot arms 204 at each end for pivotally attaching the cutting cylinder 190 to the frame 112. A transverse member 206 extends between the pivoting arms 204.

The pivoting movement of the cylinder 190 may be controlled via a number of methods. In the depicted embodiment, an externally threaded rod 210 bears against the transverse member 206. The threaded rod 210 is moved in the direction along its axis by rotating the shaft in a complimentary, internally threaded hole or bore 212 formed in or attached to the apparatus 110. In this manner, the cylinder 190 can be lowered or raised by extending or retracting the rod 210. In this manner, the cylinder 190 can be moved to a raised position when the apparatus 110 not in use or even during use when ice shaving is not desired.

In certain embodiments, the bearing end of the threaded rod 210 may be rotatably attached to the transverse member 206, e.g., using a pin-type or other rotatable fastener. Alternatively, one or more tension springs (not shown) may be provided to bias the cylinder 190 in the raised position and wherein the threaded rod 206 may be used to urge the cylinder 190 downward to the cutting position.

In the illustrated embodiment, a handle or knob 214 is provided for manually rotating the rod 210. Other means for rotating the threaded rod 210 are contemplated as well. In operation, the cutting cylinder 190 is lowered to a desired depth of cut by rotating the threaded rod 210. When storing or transporting the device during periods of nonuse, the cutting cylinder 190 is raised by rotating the threaded rod 210 in the opposite direction.

In reducing the present invention to practice, it has been found that the unit can be pulled by the operator using very little effort due to the rotational contact with the ice surface by the rotational contact of the first rotating thrower and the optional ice cutter, which helps propel the unit in the proper direction. However, the use of an additional propulsion system is also contemplated.

A watering system is provided to dispense water onto the ice and includes a water holding receptacle or tank 220 (e.g., a 26-gallon tank in the depicted embodiment). The tank 220 includes an inlet 222 having closure 224 that is removable to allow the tank to be refilled when necessary. The tank 220 also includes an outlet 226 which is fluidically coupled via a conduit 228 to a dispensing tube 230 which extends transversely across the base of the frame 112. The tank 220 is preferably fastened or secured to the unit 110. In the depicted embodiment, the tank 220 is held in place using eye-bolts 232 and straps 234.

The flow of water from the tank 220 to the dispensing tube 230 is controlled by a valve 236, which may be selectively opened to allow water to flow under the influence of gravity to the dispensing tube 230 and closed when the unit is not in use. The dispensing tube 230 has a series of spaced-apart holes through which water passes onto the ice. The amount of water which is dispensed onto the ice surface may be regulated by the degree of valve opening and/or by the size and/or spacing of the holes in the transverse tube 230. The dispensed water is then spread out evenly by mat 238, which is dragged behind the unit. The mat 238 may be a natural or synthetic, woven or non woven material and is preferably a towel, felt strip, or the like.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. An apparatus for resurfacing an ice surface, comprising:

a chassis;

a handle attached to said chassis and adapted to be grasped by an operator for manually maneuvering said apparatus over the ice surface;

a reservoir on said chassis for holding water to be dispensed;

a dispensing tube extending transversely relative to said chassis, said dispensing tube in fluid communication with said reservoir and having a plurality of spaced-apart apertures;

a scraper assembly attached to said chassis, said scraper assembly including a scraper blade extending transversely relative to said chassis and adapted to engage the ice surface;

a first thrower rotatably mounted to said chassis adjacent to said scraper blade and rotatable about a first axis extending transversely relative to said chassis;

a second thrower rotatably mounted to said chassis adjacent to said first thrower and rotatable about a second axis parallel to said first axis;

a snow storage compartment having an opening adjacent said second thrower;

said first thrower adapted to remove ice or snow accumulated by said blade from the ice surface and to deliver such ice or snow to said second thrower;

said second thrower positioned to receive ice and snow delivered by the first thrower and to deliver such ice or snow to said snow storage compartment;

a motor coupled to the chassis;

a drive linkage coupled to said motor for rotatably driving said first and second throwers; and each of said first and second throwers including a central roller member rotatably mounted on said chassis and two or more elongate, transversely extending blades projecting outwardly from said central roller, the blades of said first roller including a first layer formed of a resilient material attached to and extending outwardly from the central roller and a second layer having a surface contacting a facing surface of the first layer, said second layer formed of a rigid material attached to and extending outwardly from the central roller, wherein a portion of the resilient layer protrudes beyond the rigid layer.

2. The apparatus of claim 1, further comprising:

a rotatable ice cutter extending transversely relative to said chassis and adapted to engage the ice surface; and means for rotatably driving said ice cutter.

3. The apparatus of claim 2, further comprising:

means for selectively raising and lowering the rotatable ice cutter.

4. The apparatus of claim 2, wherein said means for rotatably driving said ice cutter includes:

a second motor coupled to said chassis; and a drive linkage coupled to said motor for rotatably driving said ice cutter.

5. The apparatus of claim 1, wherein the portion of the resilient layer that protrudes beyond the rigid layer includes a squeegee.

6. The apparatus of claim 1, further comprising:

each of said two or more blades of said first thrower including a resilient edge for contacting said scraper blade, the resilient edge selected from the group consisting of a squeegee and a brush.

7. The apparatus of claim 1, further comprising:

said first and second throwers rotating in a timed relation relative to each other during operation.

8. The apparatus of claim 7, wherein the second thrower rotates at a rate which is selected from the group consisting of a rate equal to a rate of the first thrower and a rate equal to two times a rate of the first thrower.

9. The apparatus of claim 7, further comprising:

said blades of said first thrower interleaved with said blades of said second thrower, the timed relation selected to avoid a collision of the blades of the first roller and the blades of the second roller during operation.

10. The apparatus of claim 1, further comprising:

a mat attached to said chassis and contacting the ice surface during operation.

11. The apparatus of claim 1, wherein the portion of the resilient layer that protrudes beyond the rigid layer includes a brush.

12. The apparatus of claim 1, further comprising:

a door for covering an opening in said snow storage compartment.

13. The apparatus of claim 12, further comprising:

an interlock device preventing operation of said apparatus when said door is in an open position.

14. The apparatus of claim 1, further comprising:

a linkage coupled to said scraper blade for selectively moving the scraper blade between a raised position and a lower, operable position.

15. The apparatus of claim 14, further comprising:

an interlock device preventing operation of said apparatus when said scraper blade is in the raised position.

16. A method for resurfacing an ice surface, said method comprising:

manually moving an ice resurfacing device over the ice surface using a handle attached to the ice resurfacing device, the ice resurfacing device including a chassis and a reservoir on said chassis for holding water to be dispensed;

scraping the surface of the ice with a scraper assembly attached to said chassis, said scraper assembly including a scraper blade extending transversely relative to said chassis and adapted to engage the ice surface;

removing snow collected by the scraper assembly from the ice surface with a first thrower rotatably mounted to said chassis adjacent to said scraper blade and rotatable about a first axis extending transversely relative to said chassis, said first thrower including a central roller rotatably mounted on said chassis and two or more elongate, transversely extending blades projecting outwardly from said central roller;

delivering the snow removed from the ice surface by the first thrower to a second thrower rotatably mounted to said chassis adjacent to said first thrower and rotatable about a second axis parallel to said first axis, said second thrower including a central roller rotatably mounted on said chassis and two or more elongate, transversely extending blades projecting outwardly from said central roller, the blades of said first roller including a first layer formed of a resilient material attached to and extending outwardly from the central roller and a second layer having a surface contacting a facing surface of the first layer, said second layer formed of a rigid material attached to and extending outwardly from the central roller, wherein a portion of the resilient layer protrudes beyond the rigid layer;

delivering snow received by said second thrower to a snow storage compartment having an opening adjacent said second thrower; and directing a volume of water from said reservoir to a dispensing tube extending transversely relative to said chassis, said dispensing tube in fluid communication with said reservoir and having a plurality of spaced-apart apertures.

17. The method of claim 16, further comprising:

removing a thin layer of ice from the ice surface using a rotating ice cutter extending transversely relative to said chassis and adapted to engage the ice surface.

18. The method of claim 16, wherein the second thrower rotates at a rate which is selected from the group consisting of a rate equal to a rate of the first thrower and a rate equal to two times a rate of the first thrower.

19. The method of claim 16, further comprising:

said blades of said first thrower interleaved with said blades of said second thrower; and during operation, said first and second throwers rotating in a timed relation selected to prevent a collision of the blades of the first roller and the blades of the second roller.

* * * * *